United States Patent [19]

Lui et al.

[11] Patent Number: 4,488,770

[45] Date of Patent: Dec. 18, 1984

[54] SCREW-DOWN POST TERMINAL

[75] Inventors: Hoi Lui, Cortland, Ohio; Benjamin F. Brinn, Jr., Anderson, Ind.

[73] Assignee: General Motors Corporation, Detroit, Mich.

[21] Appl. No.: 489,073

[22] Filed: Apr. 27, 1983

[51] Int. Cl.[3] ..... H01R 4/30

[52] U.S. Cl. ..... 339/263 R; 339/257; 339/277 R

[58] Field of Search ..... 339/263, 257, 277, 103, 339/184, 186

[56] References Cited

U.S. PATENT DOCUMENTS

| | | | |
|---|---|---|---|
| 968,950 | 8/1910 | Jahn | 339/263 |
| 981,501 | 4/1909 | Bolton, Jr. | 339/263 |
| 1,837,893 | 12/1931 | Bedard | 339/263 R |
| 1,994,251 | 3/1935 | Mueller | 339/184 R |
| 2,434,211 | 1/1948 | Hull et al. | 339/184 R |
| 2,877,442 | 3/1959 | Gettig | 339/258 |
| 3,129,047 | 4/1964 | Bennett | 339/257 |
| 3,286,220 | 11/1966 | Marley et al. | 339/184 M |
| 3,455,528 | 7/1969 | Meyer | 248/73 |
| 3,590,387 | 6/1971 | Landis | 339/257 |
| 4,002,390 | 1/1977 | Perry et al. | 339/263 R |
| 4,037,905 | 7/1977 | Lucas | 339/98 |
| 4,402,567 | 9/1983 | Shambaugh et al. | 339/184 M |

FOREIGN PATENT DOCUMENTS

| | | | |
|---|---|---|---|
| 29987 | 3/1977 | Japan | 339/263 R |
| 1014836 | 12/1965 | United Kingdom | 339/257 |

*Primary Examiner*—John McQuade
*Assistant Examiner*—David L. Pirlot
*Attorney, Agent, or Firm*—F. J. Fodale

[57] ABSTRACT

An electrical device has screw-down post terminals for making electrical connections to keyhole ring terminals attached to electrical leads for the device, the screw-down post terminal comprising an integral dielectric post of the device housing and a conductor disposed therein so that an end is exposed for contacting the ring terminal, the post terminal including a screw-down device for clamping the ring terminal against the exposed end of the conductor which comprises a head and a shank which connects the head to the conductor, the dielectric post having a raised arcuate shroud and a raised stop which angularly positions the ring terminal and ensures proper engagement therewith.

2 Claims, 3 Drawing Figures

SCREW-DOWN POST TERMINAL

This invention relates generally to electrical connections and, more particularly, to electrical connections in which a keyhole ring terminal is secured to a screw-down post terminal.

U.S. Pat. No. 918,501 issued to George W. Bolton, Jr. on Apr. 20, 1909 and U.S. Pat. No. 968,950 issued to Edwin P. Jahn on Aug. 30, 1910 both show an electrical connection in which a keyhole ring terminal is secured to a post terminal having a screw-down device for clamping the ring terminal. In the Bolton arrangement, the screw-down device is a machine screw, and the ring terminal keyhold is sized for assemblying the ring terminal over screw head and engaging the screw shank in the slot portion of the keyhole. In the Jahn arrangement, the screw-down device is a thumb nut on a threaded shank. In both arrangements, the ring terminal can be attached to the post terminal at any angular position and a particular angular position can be achieved by hand assembly. However, the task is difficult and subject of error. Moreover, once achieved, the particular angular position is then maintained solely by the frictional forces produced by the screw-down device.

These prior art arrangements are not desirable where a particular angular position is necessary because of the requirement for tedious and error free hand assembly and the reliance on the frictional forces produced by the screw-down device to maintain the angular position of the ring terminal.

The object of this invention is to provide an improved arrangement wherein the post terminal has positive means for angularly positioning the ring terminal during assembly and subsequent use so that a particular angular orientation can be easily achieved and then maintained even in the absence of frictional forces.

A feature of the invention is that positive positioning means also fully engages the shank of the screw-down in the slot portion of the ring terminal keyhold before the head can be screwed down thus assuring a proper electrical connection.

Another feature of the invention is that the positive positioning means retains the ring terminal in assembly with the post terminal as well as in the desired angular position even if the screw-down device loosens considerably during subsequent use.

Other objects and features of the invention will become apparent to those skilled in the art as the disclosure is made in the following detailed description of a preferred embodiment of the invention as illustrated in the accompanying sheet of drawing in which.

Figure 1:
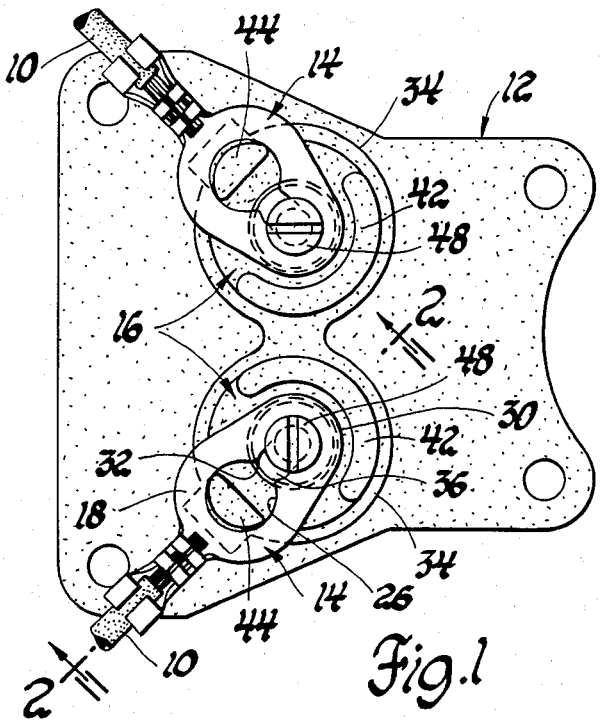
FIG. 1 is a top view of an electrical device having screw-down post terminals in accordance with our invention.

Referring now to the drawing, FIG. 1 shows two leads 10 connected to an electrical device 12, such as a solenoid, by respective adjacent connections which each comprise a ring terminal 14 and a screw-down post terminal 16.

The ring terminal 14 comprises a flat oblong ring 18 having a suitable lead attachment 20, such as the conventional crimp barrel 22, projecting from one end for attaching the ring terminal 14 to a lead 10. The flat oblong ring 18 defines a keyhole 24 which comprises a circular portion 26 and a communicating slot portion 28. The keyhole 24 is oriented so that the circular portion 26 is toward the lead attachment 20 and the slot portion 28 extends toward the tip 30 of the ring 18 opposite the lead attachment 20. The entrance of the slot portion 28 is restricted by resilient projections 32 on the side wall defining the slot portion.

The screw-down post terminal 16 comprises a dielectric post 34 surrounding a conductor 36. The conductor 36 is electrically connected to electrical components of the electrical device 12 (not shown) and is disposed in the dielectric post 34 so that the end 38 is exposed for contacting the ring terminal 14. As illustrated, the post 34 may be molded as an integral part of a thermoplastic housing for the electrical device 12 and the conductor 36 may take the form of a mold insert which is positioned in the mold so that the end 38 of the conductor core 36 projects above the surrounding surface of the boss 34 to keep the end face 39 free of molding material during the molding process.

Figure 2:
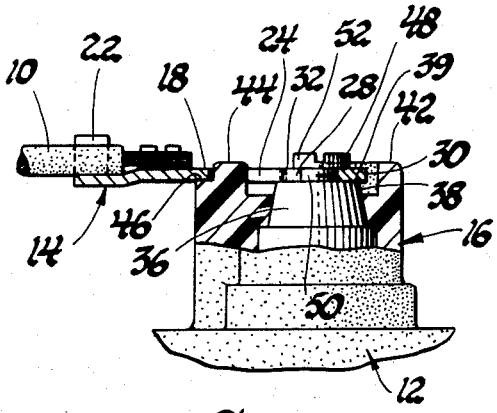
FIG. 2 is a section taken substantially along the line 2—2 of FIG. 1 looking in the direction of the arrows.
Figure 3:
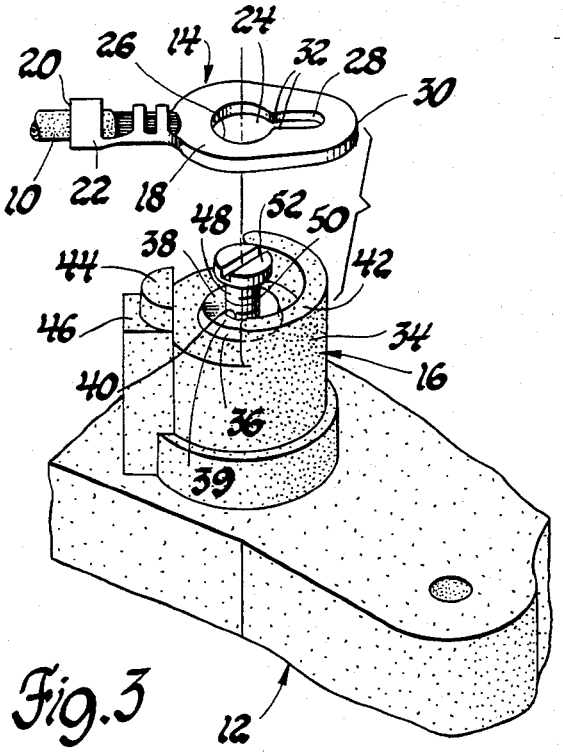
FIG. 3 is an exploded perspective view of a portion of FIG. 1 showing the ring terminal in the process of being assembled to the screw-down post terminal.

The conductor 36 has a threaded bore 40 which opens onto the end face 39 and the dielectric post boss 34 includes a raised arcuate shroud 42 which is radially spaced from the threaded bore 40 and which has a height substantially greater than the projecting end 38 of the conductor 36 as shown in FIGS. 2 and 3. The post 34 also has a raised stop 44 which is radially spaced from the threaded bore 40 and which is spaced from each circumferential end of the shroud 42. The raised stop 44 preferably has the same height as the shroud 42 as shown in FIG. 2. The post 34 also includes a ledge 46 which is radially outward of the raised stop 44 and which has the same height as the projecting end 38 of the conductor 36.

The screw-down device of the post terminal 16 may take the form of a simple machine screw 48 which has a threaded shank 50 and a slotted head 52. The machine screw 48 is preassembled to the conductor 36 by screwing the threaded shank 50 partway into the threaded bore 40 so that the slotted head 52 of the machine screw 48 is spaced above the raised shroud 42 and stop 44 for assembly of the ring terminal 14 as shown in FIG. 3. At a minimum, the spacing is equal to the thickness of the flat oblong ring 18 plus a sliding clearance so that the ring 18 can be placed on the shroud 42 and stop 44 and then slid beneath the head 52. The screw-down device could also take the form of a threaded shank or stud on the conductor 38 and a bolt head which would be preassembled part way down on the threaded shank.

The ring terminal 14 is assembled to the post terminal 16 by inserting the screw head 52 through the circular portion 26 of the keyhole 24 and resting the ring terminal on the raised shroud 42 and stop 44 as shown in FIG. 3. In this regard, the substantial arcuate extent of the shroud allows a wide tolerance of initial positioning and permits indexing to the correct angular position shown in FIG. 3. The ring terminal 14 is then pulled back, i.e., toward the left as viewed in FIG. 3, until the threaded screw shank 50 is fully seated in the keyhole slot portion 28 behind the projections 32.

The shroud 42 and stop 44 are radially spaced from the shank 50 so that the tip 30 of ring terminal 14 drops down off the shroud 42 and the circular portion 26 of the keyhole 24 drops over the stop 44 when the threaded shank 50 is fully seated in the keyhole slot portion 28. If the shank 50 is not fully seated, the ring terminal 14 hangs up on the shroud 42 and stop 44. Thus, the shroud 42 and stop 44 insure full slot engagement as well as positively angularly position the ring terminal 14 for final assembly.

The electrical connection is then completed by screwing the machine screw 48 down tightly to clamp and secure the ring terminal 14 as shown in FIGS. 1 and 2. The ledge 46 is preferably coplanar with the end face 39 to provide a good support during screw-down and for the clamped ring terminal 14.

In the event that the machine screw 48 is vibrated loose during use, the raised shroud 42 and stop 44 keep the ring 18 under the screw head 52 and prevent rotation of the ring terminal 18. This reduces the risk of a short circuit and a complete detachment of the ring terminal 14 even under the most adverse conditions.

I wish it to be understood that I do not desire to be limited to the exact details of construction shown and described, for obvious modifications will occur to a person skilled in the art.

The embodiments of the invention in which an exclusive property or privilege is claimed are defined as follows:

1. A screw-down post terminal for making an electrical connection to a ring terminal having a keyhole comprising:

a dielectric post having a conductor disposed therein so that the conductor has an exposed end for contacting the ring terminal, a screw-down device for clamping the ring terminal against the exposed end of the conductor, said screw-down device comprising a head and a shank which connects the head to the conductor, and positive means on the dielectric post for angularly positioning the ring terminal comprising a raised arcuate shroud and a raised stop spaced from each circumferential end of the raised arcuate shroud, said raised arcuate shroud being radially spaced from the shank of the screw-down device so that the shank is fully disposed in the slot portion of the keyhole when the ring terminal contacts the conductor, and said raised stop being radially spaced from the shank so that the raised stop is disposed in another portion of the keyhole to angularly position the ring terminal.

2. A screw-down post terminal for making an electrical connection to a ring terminal having a keyhole aperture comprising:

a dielectric post having a conductor disposed therein so that the conductor has an exposed end face for contacting the ring terminal, a screw-down device for clamping the ring terminal against the exposed end of the conductor, said screw-down device comprising a head and a thread shank which connects the head to the conductor for movement of the head toward and away from the conductor, and positive means on the dielectric post for angularly positioning the ring terminal comprising a raised arcuate shroud and a raised stop which is substantially the same height as the raised arcuate shroud and which is spaced from each circumferential end of the raised arcuate shroud, said raised arcuate shroud being radially spaced from the shank of the screw-down device so that the shank is fully disposed in the slot portion of the keyhole aperture when the tip of the ring terminal clears the shroud, said raised stop being radially spaced from the shank so that the stop is disposed in another portion of the keyhole aperture to angularly position the ring terminal when the tip of the ring terminal clears the shroud, and a ledge outwardly of the raised stop which is coplanar with the exposed end face of the conductor to provide a support for the ring terminal.

* * * * *